US008418501B2

(12) United States Patent
Harder

(10) Patent No.: US 8,418,501 B2
(45) Date of Patent: Apr. 16, 2013

(54) APPARATUS FOR SUSPENDING OBJECTS FROM EARS

(76) Inventor: Michele Harder, Fort Worth, TX (US)

( * ) Notice: Subject to any disclaimer, the term of this patent is extended or adjusted under 35 U.S.C. 154(b) by 430 days.

(21) Appl. No.: 11/933,404

(22) Filed: Oct. 31, 2007

(65) Prior Publication Data

US 2008/0134720 A1 Jun. 12, 2008

Related U.S. Application Data

(60) Provisional application No. 60/863,783, filed on Oct. 31, 2006, provisional application No. 60/885,216, filed on Jan. 16, 2007.

(51) Int. Cl.
*A44C 7/00* (2006.01)

(52) U.S. Cl.
USPC ..... 63/14.8; 63/13; 63/14.1; 63/40

(58) Field of Classification Search ..... None
See application file for complete search history.

(56) References Cited

U.S. PATENT DOCUMENTS

| | | | | | |
|---|---|---|---|---|---|
| 20,480 | A * | 6/1858 | Carpenter | 63/14.2 |
| 48,677 | A * | 7/1865 | Grant | 132/275 |
| 129,871 | A * | 7/1872 | Stevens | 24/3.13 |
| 1,344,556 | A * | 6/1920 | Moler | 63/14.2 |
| 2,040,083 | A * | 5/1936 | Elliott et al. | 63/14.2 |
| 5,146,768 | A * | 9/1992 | Dichtel | 63/14.8 |
| D348,853 | S * | 7/1994 | Currie | D11/43 |
| 5,845,518 | A * | 12/1998 | Webber | 63/14.4 |
| 6,282,921 | B1 * | 9/2001 | Carter | 63/12 |
| 7,568,364 | B1 * | 8/2009 | Buskop | 63/14.1 |

* cited by examiner

*Primary Examiner* — Jack W. Lavinder
(74) *Attorney, Agent, or Firm* — Jack D. Stone, Jr.; Scheef & Stone, L.L.P.

(57) ABSTRACT

An open-ended ring is configured for being secured to the cartilage at the base of the outer ear, above the ear lobe. Means are provided for suspending ornamental pendants from the ring.

8 Claims, 13 Drawing Sheets

APPARATUS FOR SUSPENDING OBJECTS FROM EARS

CROSS-REFERENCE TO RELATED APPLICATIONS

This application claims the benefit of U.S. Provisional Application No. 60/863,783, filed Oct. 31, 2006, and U.S. Provisional Application No. 60/885,216, filed Jan. 16, 2007, both of which applications are hereby incorporated herein by reference, in their entirety.

TECHNICAL FIELD

The invention relates generally to ornamental objects, such as pendants, worn on, or suspended from, one or both ears of a person, and, more particularly, to an apparatus or article and method for suspending ornamental objects, such as pendants, worn on, or suspended from, one or both ears of a person.

BACKGROUND

A common way to wear ornamental items, also known as earrings, on a person's ears is by piercing an ear so that earrings may be pinned to an ear. For any of a number of reasons, many people prefer not to have their ears pierced, and so restrict themselves to wearing earrings, such as clip earrings, that may be secured to an ear without being pinned to the ear with posts. Clip earrings though are often uncomfortable and, like pin earrings, over the course of time, tend to cause an ear lobe to sag. Therefore, there is a need for an earring that may be secured to an ear without conventional posts or clips, and which is also comfortable to a wearer of the earring and which does not cause sagging earlobes.

SUMMARY OF THE INVENTION

The present invention, referred to herein as an earling or earling assembly, accordingly, comprises an article similar to an ear cuff or toe ring, which is preferably configured and modified for being attached to the cartilage, or anti-tragus, at the base of the outer ear, above the ear lobe, and, unlike conventional ear cuffs or toe rings, is preferably positioned on a lower-most part of the ear. Means, such as one or more hooks, posts, holes, and/or the like, extend from, or are defined by, the earling for suspending ornamental pendants therefrom.

The earling is generally defined by a symmetrical or asymmetrical, circular or elliptical, open-ended ring attached to the cartilage of the ear. The ring may be altered by size, shape, and style to accommodate different sizes of ears, and any number and kind of ornamental pendants, or other objects, attached thereto, and/or suspended or dangled therefrom.

In further preferred embodiments of the invention, earlings may be configured to gently pin back the soft, non-cartilage portion of the ear. Unlike conventional earcuffs, earlings are configured to preferably be worn on both ears.

Earlings may preferably be sized to fit any ear, and styled to hug closely to or fit loosely around, the ear. Earlings may optionally include padding to make wearing of the earling more comfortable, e.g., so ends of the earling do not protrude uncomfortably into an ear. Padding may optionally be provided for the earling, such padding comprising material which is similar to the material from which the earling is fabricated.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIGS. 19-21 exemplify an alternate embodiment of the invention defining holes, wherein FIG. 19 depicts an elevation view of the embodiment, and FIGS. 20-21 depict side and frontal views of the invention positioned on the ear of FIG. 1;

FIGS. 22-26 exemplify a further alternative embodiment of the invention, wherein FIGS. 22-24 depict perspective, front, and rear elevation views, respectively, of the embodiment, and FIGS. 25-26 exemplify side and frontal views of the embodiment positioned on the ear of FIG. 1;

FIGS. 27-31 exemplify a further alternative embodiment of the invention, wherein FIG. 27 depicts a pre-fabrication view of a band utilized in the embodiment, FIGS. 28 and 29 depict front and rear elevation views of the band, and FIGS. 30 and 31 depict side and frontal views, respectively, of the band positioned on the ear of FIG. 1;

DETAILED DESCRIPTION

In the following discussion, numerous specific details are set forth to provide a thorough understanding of the present invention. However, it will be obvious to those skilled in the art that the present invention may be practiced without such specific details. In other instances, well-known elements have been illustrated in pictorial form in order not to obscure the present invention in unnecessary detail.

In addition to the following discussion and description, details of additional preferred embodiments of the present invention are further described and disclosed in an Appendix, which is attached herewith and hereby incorporated by reference in its entirety.

Figure 1:
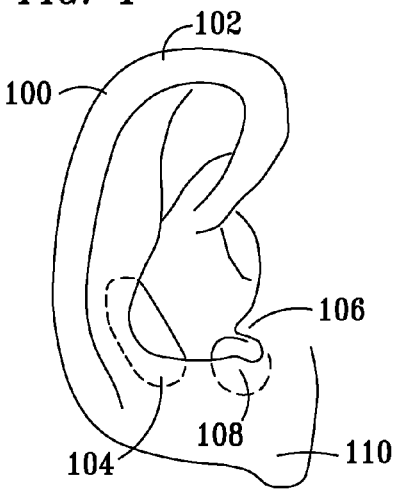
FIG. 1 exemplifies a side view of a human ear.

Referring to FIG. 1, a human ear, and more specifically, a human right ear, defined largely by underlying cartilage, is designated by the reference numeral 100. As is well-known, portions of the ear 100 includes, but are clearly not limited to, a helix 102, an anti-helix 104, a tragus 106, an anti-tragus 108, and a lobule, or lower earlobe, 110. While the invention described herein is described with respect to one ear, namely, the right ear, it is to be understood that the invention may well be, and is preferably, applied with respect to both ears, that is, both a left and a right ear, and reference to "ear" is understood to mean left or right ear, preferably both ears.

Figure 2:
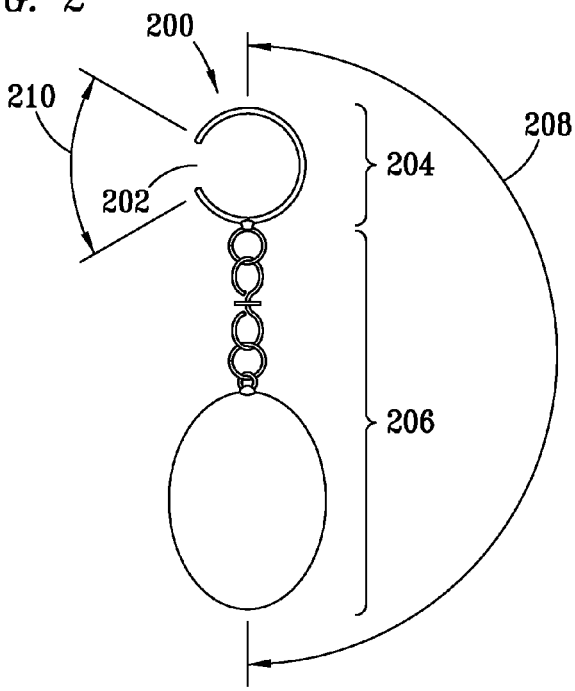
FIGS. 2-4 exemplify an earling embodying features of the present invention, wherein in FIG. 2 depicts the earling by itself, and in FIGS. 3 and 4, depict side and frontal views, respectively, of the earling positioned on the ear of FIG. 1.

Referring to FIG. 2 of the drawings, the reference numeral 200 generally designates an assembly embodying features of the present invention. The assembly 200, referred to herein as an "earling assembly", includes a portion 204, referred to herein as an "earling", and an ornamental object, dangle, or pendant, suspended from the earling 204, an example of which pendant is designated in FIGS. 2-4 by the reference numeral 206. The earling 204 may be configured similarly to a toe ring or ear cuff, but sized for fitting over the anti-tragus 108 and/or earlobe 110 of the ear 100 sufficiently closely to be comfortable, and yet remain secured thereto, and preferably to also gently pin back the soft, non-cartilage portion of the ear 100 and/or earlobe 110. The earling 204 is preferably fabricated from a metal such as silver, gold, stainless steel, a non-metallic material (e.g., plastic), a combination thereof, or the like, such material preferably being effective for allowing the size of the earling to be adjusted to fit sufficiently closely to the ear 100 as to be both comfortable and secure for a user. The earling 204 preferably defines an opening 202 of approximately 30° to 60°, and an arc 208 of about 90° to 180° substantially opposite the opening 202, within which arc 208 a pendant, such as the pendant designated by the reference numeral 206, is secured to the earling 202. The pendant 206 is configured for attachment to, and suspension from, the earling 204, and may be configured in any of a number of different ways, much as ornamental objects that are suspended from, or which constitute a portion of, conventional earrings, and as described in alternate embodiments below. The pendant 206 may also be positioned proximate to the earling 204 to thereby cover ear lobe 110. The pendant 206 is secured to the earling 204 in any suitable manner, such as by the use of solder (exemplified in FIG. 2), adhesive, a hook and mating hook/hole, a pendant holder, jump rings, or the like, and the earling may preferably be adjusted to accommodate different pendant.

Figure 3:
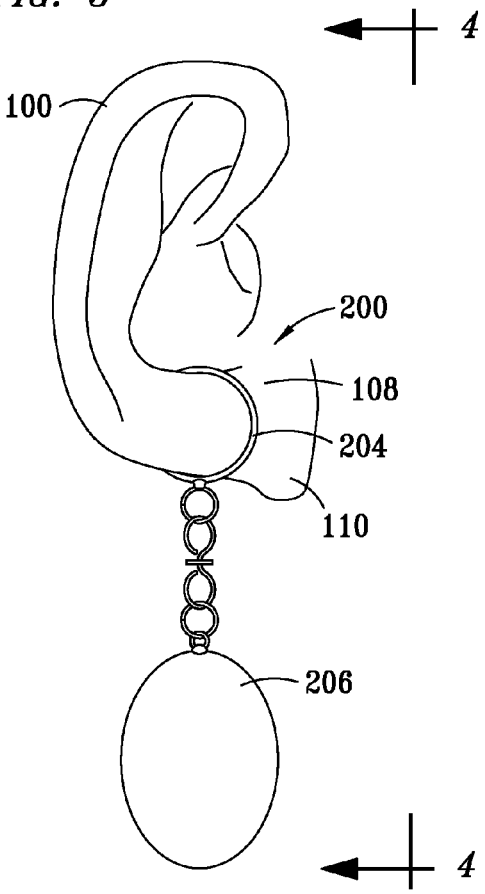
Figure 4:
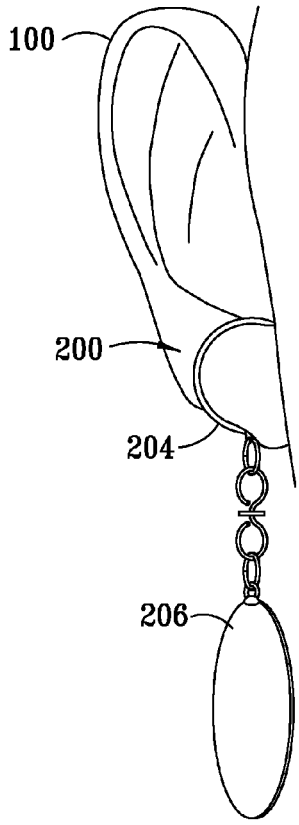

FIGS. 3 and 4 show side and frontal elevation views, respectively, of the earling 204 positioned on the ear 100. More specifically, the earling 204 is positioned on the cartilage proximate to the anti-tragus 108, and preferably also urges the earlobe 110 toward user's head, while the pendant 206 is suspended downwardly. To place the earling assembly 200 on the ear 100, the opening 202 is preferably positioned proximately over the helix 102 or anti-helix 104 and slid downwardly until it rests comfortably on the anti-tragus 108, proximate to the ear lobe 110. To remove the earling assembly 200 from the ear 100, the earling 204 is preferably slid upwardly along the anti-helix 104 until it may be readily removed therefrom.

Figure 5:
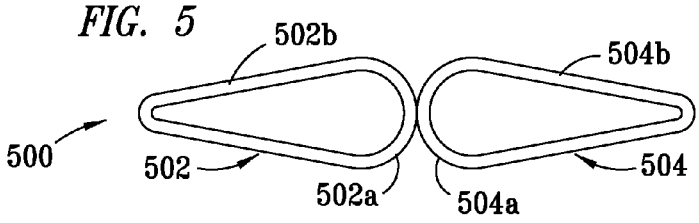
FIGS. 5-8 exemplify an alternate embodiment of the present invention, including a pre-fabricated embodiment of same in FIG. 5, a fabricated embodiment of same in FIG. 6, and in FIGS. 7 and 8, side and frontal views, respectively, of the earling positioned on the ear of FIG. 1.
Figure 6:
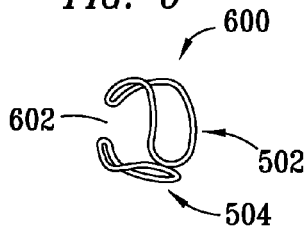

FIGS. 5 and 6 depict an earling 502 prior to and subsequent to, respectively, being shaped for use as an earling according to an alternate embodiment of the invention. As shown in FIG. 5, the earling 502 comprises two generally triangular-shaped sections 502 and 504 having respective curved bases 502*a* and 504*a*, and two substantially straight sides 502*b* and 504*b*, respectively. The bases 502*a* and 504*a* are connected together, for example, by way of solder, adhesive, or the like. As shown in FIG. 6, the sections 502 and 504 are shaped to form an earling 600, defining an opening 602.

Figure 7:
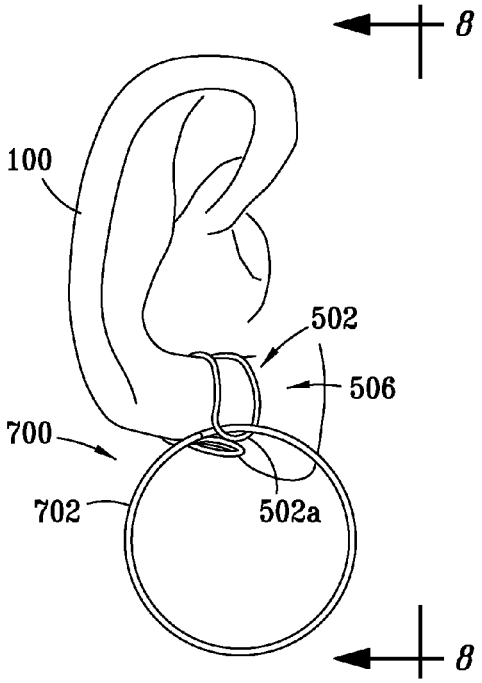
Figure 8:
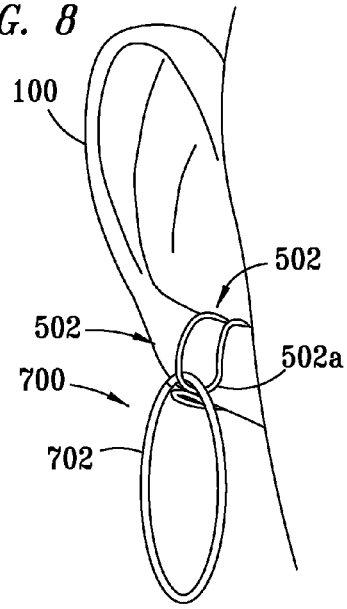

FIGS. 7 and 8 depict side and frontal view, respectively, of the earling 600 positioned on the ear 100. A pendant, exemplified as a generally ring-shaped pendant, 702 is suspended from the base 502*a* of the earling 600 in such a manner as to form an earling 700 wherein the pendant 702 is rendered most visible from the side view (FIG. 7).

Figure 9:
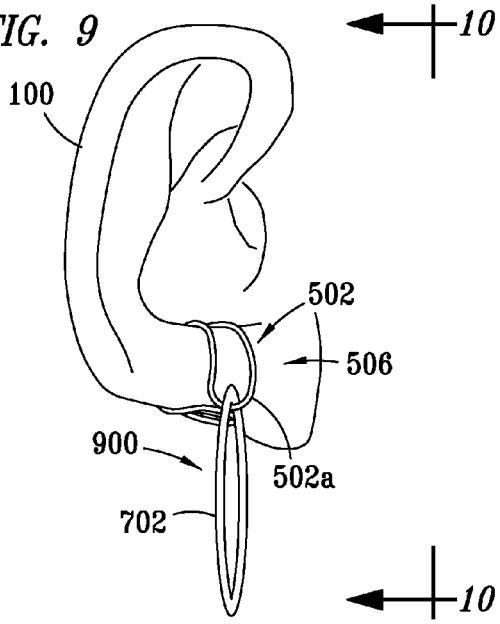
FIGS. 9-10 exemplify side and frontal views, respectively, of an alternate embodiment of the earling of FIGS. 5-8.
Figure 10:
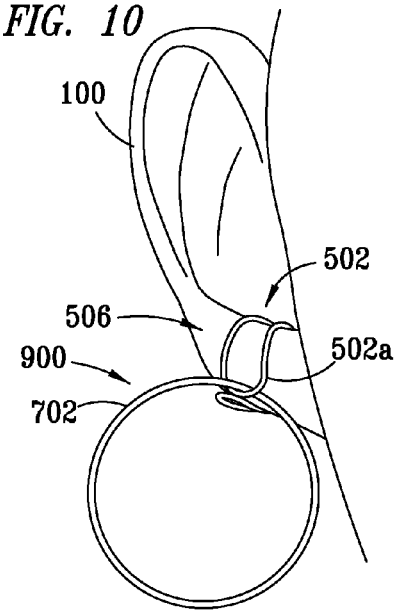

FIGS. 9 and 10 depict an alternate embodiment of the earling 700, designated by the reference numeral 900, wherein the pendant 702 is suspended from the earling 600 in an opposing manner from that depicted in FIGS. 7 and 8, to thereby render the pendant 702 most visible from the frontal view (FIG. 10). Placement of the earlings 700 and 900 on the ear 100, and their removal therefrom, is accomplished in a manner substantially similar to that described above with respect to FIGS. 3-4.

Figure 11:
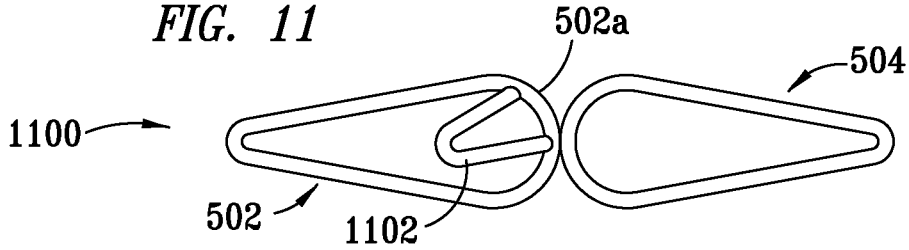
FIGS. 11-14 exemplify an alternate embodiment of the present invention, including a pre-fabricated embodiment of same in FIG. 11, a fabricated embodiment of same in FIG. 12, and in FIGS. 13 and 14, side and frontal views, respectively, of the earling positioned on the ear of FIG. 1.
Figure 12:
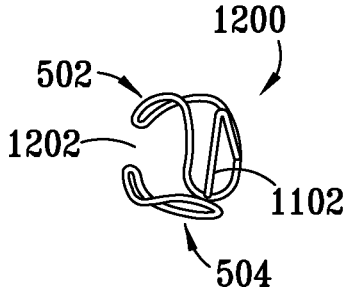

FIGS. 11 and 12 depict an alternate embodiment of the earling 500 and 600, designated by the reference numerals 1100 and 1200, prior to and subsequent to, respectively, being shaped for use as an earling according to a further alternate embodiment of the invention. As shown in FIG. 11, the earling 1100 comprises the two generally triangular-shaped sections 502 and 504 described above with respect to FIGS. 5-6, and further comprises a hook attachment 1102 extending from the base 502*a*. The hook attachment 1102 may be altered in length, width, and angle to achieve different effects with different pendants, or, for example, to allow large earring designs to be attached thereto to cover the entire earlobe 110, or a portion of it. As shown in FIG. 12, the earling 1100 is shaped to form the earling 1200 further defining an opening 1202.

Figure 13:
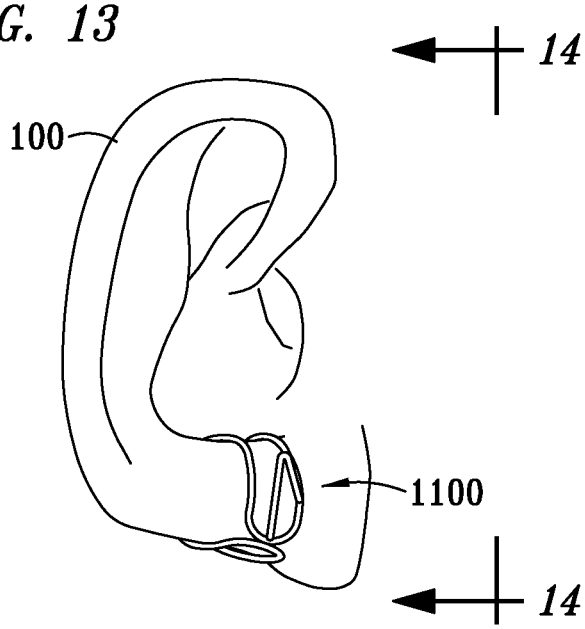
Figure 14:
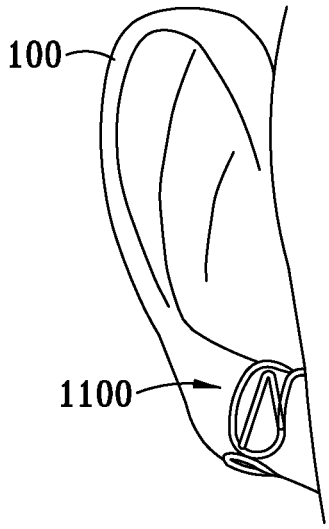

FIGS. 13 and 14 depict side and frontal views, respectively, of the earling 1200 positioned on the ear 100. The earling 1200 may be positioned on the ear 100 with or without a pendant (e.g., the pendant 206, FIG. 2) suspended from the hook attachment 1102, and would be positioned thereon, and removed therefrom, in a manner substantially similar to that described above with respect to the earling 200 of FIGS. 3-4. If the earling 1200 is positioned on the ear 100 without the pendant, then the pendant may be hung onto the hook attachment 1102 subsequent to positioning of the earling 1200 on the ear 100. Different pendants (not shown) may also be exchanged and hung from the hook attachment 1102 while the earling is in place on the ear 100.

Figure 15:
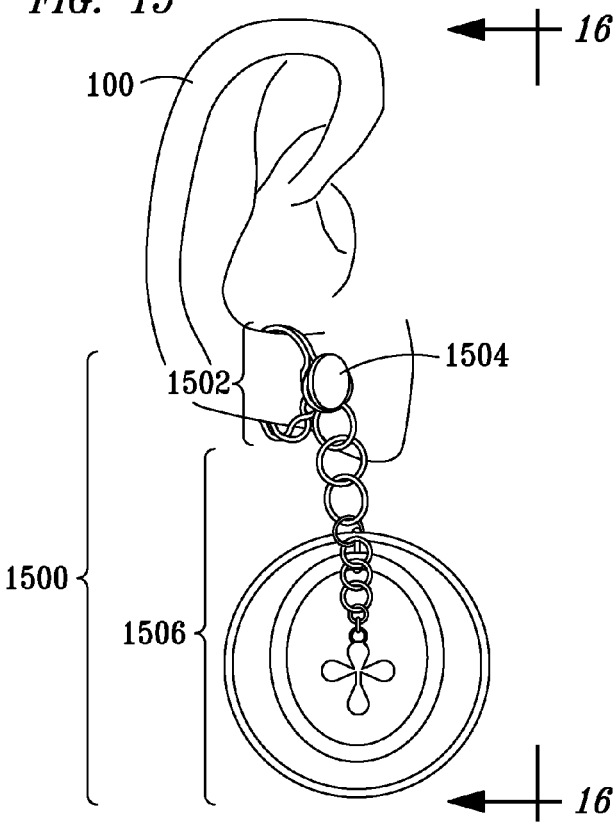
FIG. 15-16 exemplify side and frontal views, respectively, of an alternate embodiment of the invention utilizing a post attachment.
Figure 16:
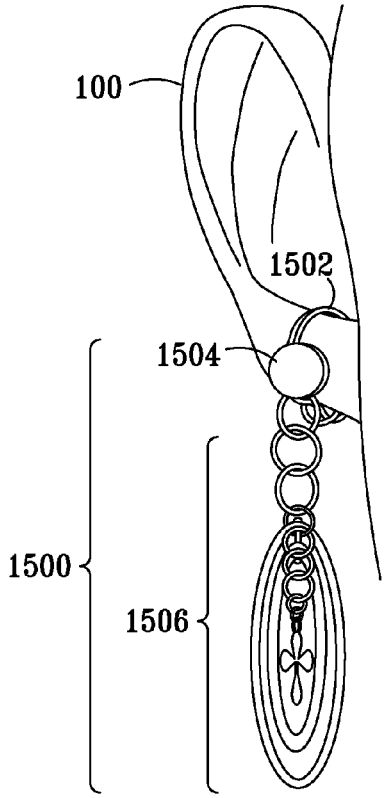

FIGS. 15-16 depict side and frontal views, respectively, of an earling assembly 1500 in accordance with a further embodiment of the invention. The earling assembly 1500 comprises an earling 1502, preferably comprising braided wire, configured for receiving a conventional earing having a post 1504, from which post an earing, such as the earing 1506, is suspended. While the earling 1502 is depicted as braided, the earling may be configured in any suitable manner suitable for receiving a conventional earing post. The earling 1502 thus facilitates adapting any earing, configured for pierced ears, to be worn by way of the earling, without having to pierce the ear. In use, the earling is secured to the ear 100, as described above with respect to FIGS. 3-4, and a conventional earing 1506 secured to the earling, preferably before, but alternatively, after, the earling is positioned on the ear. The earling is removed as described above with respect to FIGS. 3-4.

Alternatively, the post 1504 of FIGS. 15-16 may be separate from an earing or pendant, and secured to the earling 1502 by way of solder, adhesive, or the like, or a threaded nut (not shown) may secured to the earling 1502, and the post 1504 threaded, or screwed, to the nut, or a bent post or hook extending from a pendant may engage the braided earling 1502. In use, the earling 1502 may be positioned on the ear 100, and removed therefrom, in a manner substantially similar to that described above with respect to FIGS. 3-4. The pendant 1506 may be positioned on the post 1504 before or after the earling is positioned on the ear 100. In the alternative embodiment in which the post is screwed on the earling 1502, the pendant may be positioned on the nut, and the post 1504 threaded to the nut to thereby secure the pendant 1506 to the earling 1502.

Figure 17:
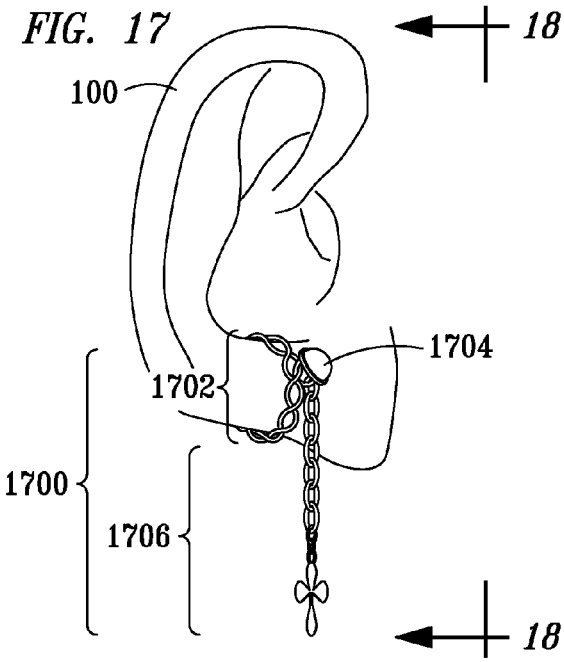
FIGS. 17-18 exemplify side and frontal views, respectively, of a further alternate embodiment of the invention utilizing braiding.
Figure 18:
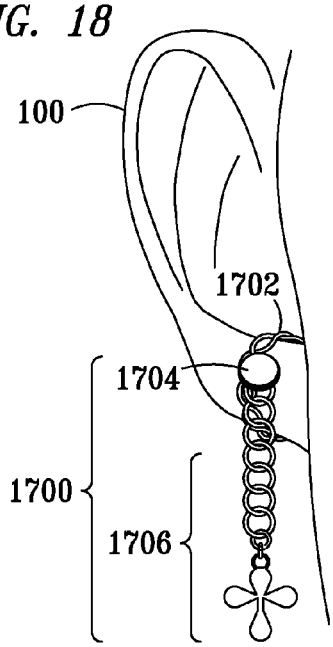

FIGS. 17 and 18 depict side and frontal views, respectively, of an earling 1700 in accordance with a further alternate embodiment of the invention. The earling 1700 comprises a braided earling 1702 otherwise similar to the earling 1502, but for a post 1704 laced into the braiding of the earling 1702. A pendant, such as the pendant designated by the reference numeral 1704, is suspended from the post 1704. In use, the earling 1702 may be positioned on the ear 100, and removed therefrom, in a manner substantially similar to that described above with respect to FIGS. 3-4. The pendant 1704 may be positioned on the post 1704 before or after the earling 1702 is positioned on the ear 100, and may be changed out with another pendant (not shown) as desired.

Figure 19:
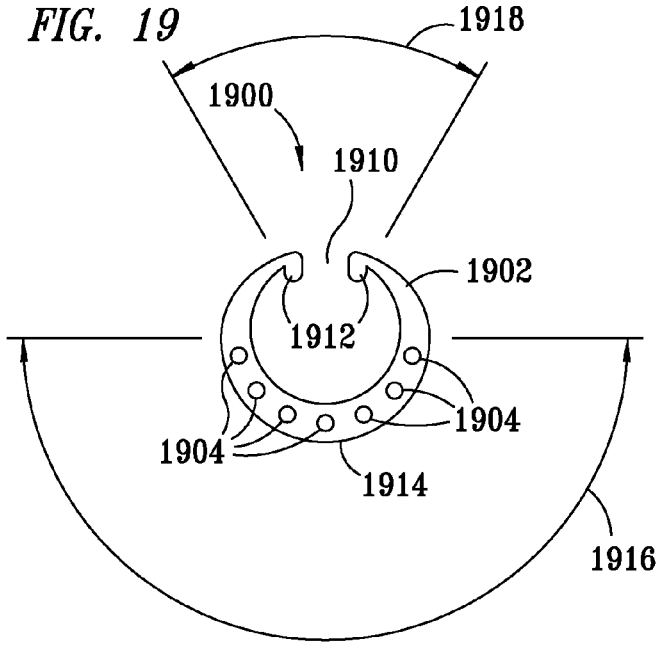

FIG. 19 depicts an earling 1900 in accordance with a still further embodiment of the invention. The earling 1900 is preferably formed (e.g., stamped out) from flat metal plate having an open-ended, ring-shaped article having a body 1902 and two pronged ends 1912 defining an opening 1910, which opening is preferably open across an arc 1918 of approximately 30° to 60° of the ring. The body 1902 defines a plurality of holes 1904 from which, and a convex edge 1914 across which, a pendant, described below with respect to FIGS. 20-21, may be suspended. The plurality of holes 1904 are preferably defined within an arc of 1916 of about 180° or less opposite the opening 1910. It is understood that the number of holes 1904 depicted is by way of example, but not limitation.

Figure 20:
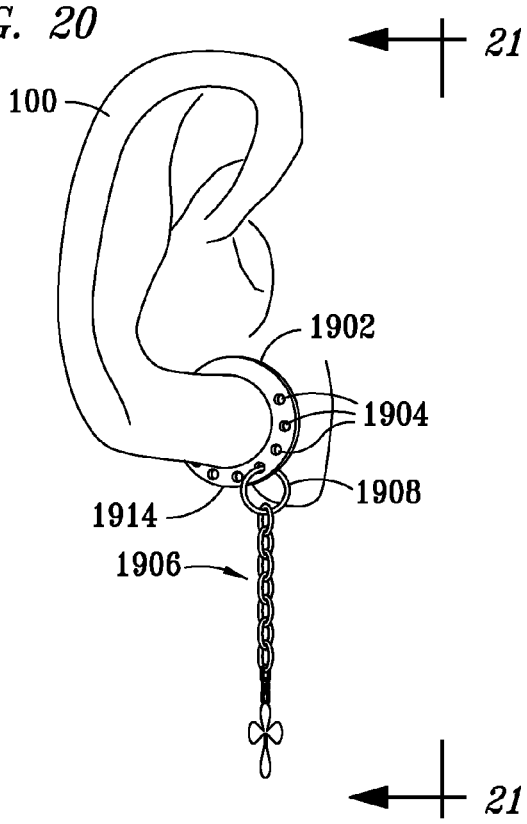
Figure 21:
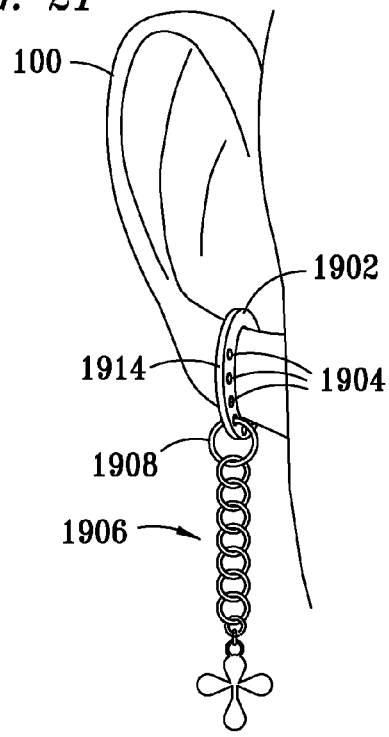

FIGS. 20-21 depict side and frontal views, respectively, exemplifying how the earling 1900 of FIG. 19 may be worn on the ear. As shown therein, a pendant, such as designated by the reference numeral 1906, is suspended from the earling 1900 by way of a smaller ring 1908 which extends through a selected hole 1904, and across the convex edge 1914 of the body 1902. In use, the earling 1900 may be positioned on the ear 100, and removed therefrom, in a manner substantially similar to that described above with respect to FIGS. 3-4.

Figure 22:
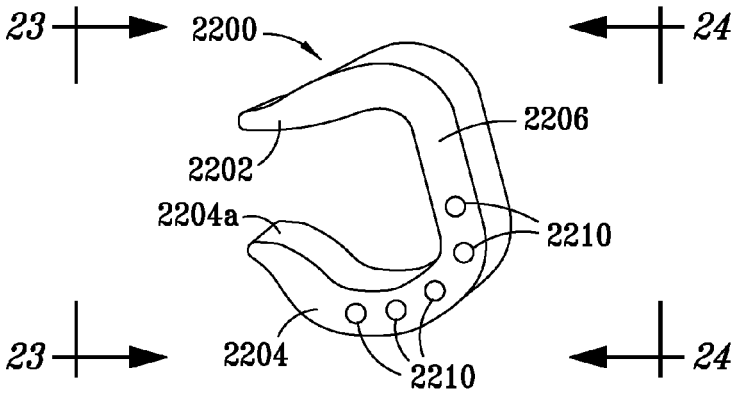

FIG. 22 is a perspective view of an earling 2200 according to a further alternate embodiment of the invention. The earling 2200 is generally configured in a C-shape having an upper portion 2202, a lower portion 2204, and an intermediate portion 2206 extending generally vertically (as viewed in FIG. 22) between the upper portion 2202 and the lower portion 2204. The lower portion 2204 preferably includes an upturned end 2204*a*, and a plurality of holes 2206 are defined between the lower portion 2204 and the intermediate portion 2206 from which pendants are suspended, as described further below with respect to FIGS. 25-26. It is understood that the number of holes 2206 depicted are by way of example, but not limitation.

Figure 23:
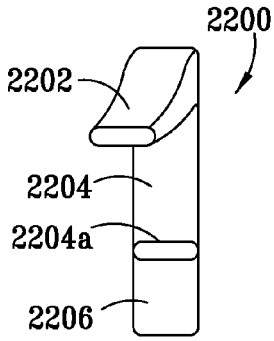
Figure 24:
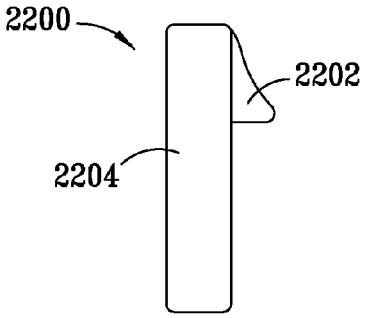

FIGS. 23 and 24 are elevation views of the earling of FIG. 22 taken along the lines 23-23 and 24-24, respectively, of FIG. 22. As shown, the upper portion 2204 of the earling 2200 is preferably canted to one side to facilitate fitting of the earling 2200 on the ear 100 and, more specifically, about the anti-tragus 108. It can be appreciated that the direction of the cant of the upper portion 2202 for one ear 100 (e.g., the right ear) would be opposite the direction of cant for the upper portion 2202 of the other ear (e.g., the left ear, not shown).

Figure 25:
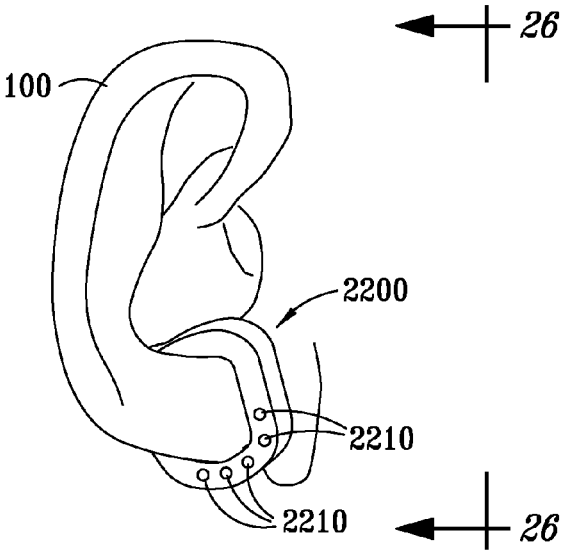
Figure 26:
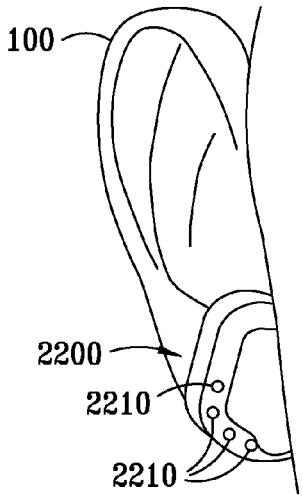

FIGS. 25 and 26 depict side and frontal views, respectively, exemplifying how the earling 2200 of FIGS. 22-24 may be worn on the ear 100. In use, the earling 2200 may be positioned on the ear 100, and removed therefrom, in a manner substantially similar to that described above with respect to FIGS. 3-4. While not shown, a pendant may be suspended from the earling via a hole 2210, either prior to or subsequent to placement of the earling 2200 on the ear 100.

Figure 27:
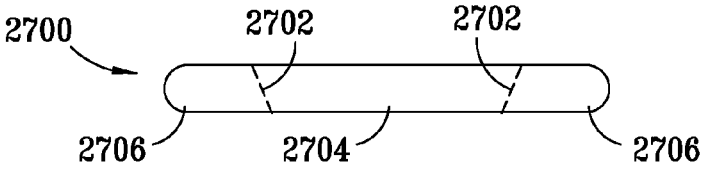

FIG. 27 depicts a band 2700 prior to being shaped into an earling. The band 2700 depicts two centerlines 2702 about which the band 2700 is generally bent when shaped to form an earling, described further below with respect to FIGS. 28-31. The centerlines 2702 demarcate a center portion 2704 and end portions 2706 of the band 2700.

Figure 28:
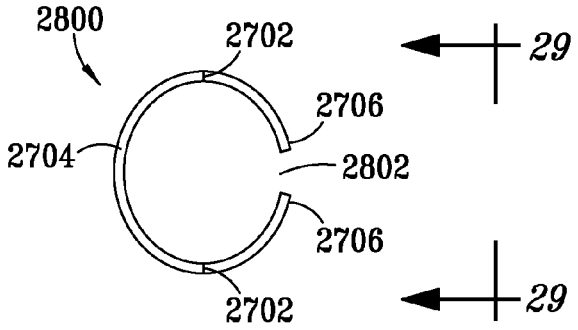
Figure 29:
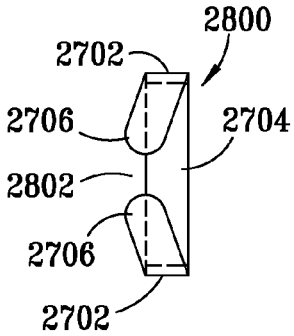

FIG. 28 depicts one elevation view of the band 2700 shaped to form an earling 2800, similar to a conventional toe ring, and FIG. 29 depicts an elevation view of the earling 2800 taken along the line 29-29 of FIG. 28. As shown most clearly in FIG. 28, the band 2700 is shaped to form a substantially circular shape having an opening 2802 defined therein. As shown in FIG. 29, the band 2700 is further shaped along the centerlines 2702 so that the end portions 2706 are canted away from the plane of the earling 2800 to more closely conform to the ear 100 and, more specifically, about the anti-tragus 108 of the ear.

Figure 30:
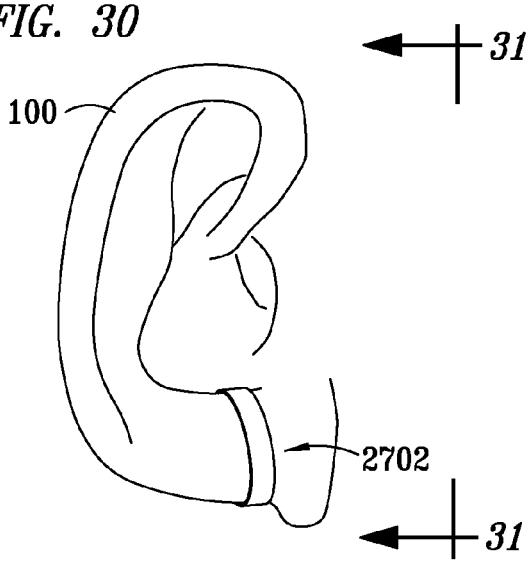
Figure 31:
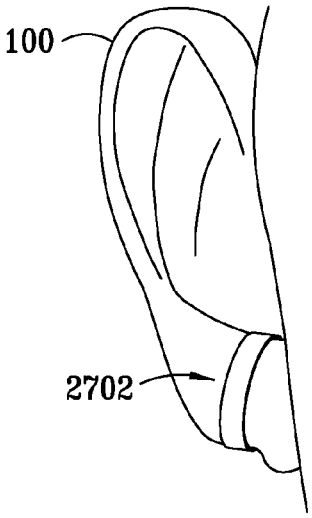

FIG. 30 depicts an elevation view of the earling 2800 positioned on the ear 100, and FIG. 31 is an elevation view of same taken along the line 31-31 of FIG. 30. In use, the earling 2800 may be positioned on the ear 100, and removed therefrom, in a manner substantially similar to that described above with respect to FIGS. 3-4.

Figure 32:
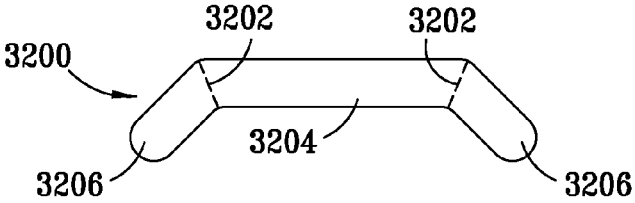
FIG. 32 exemplifies an alternative embodiment of the band of FIG. 27, configured for facilitating fabrication of the invention.

FIG. 32 depicts a band 3200 prior to being shaped into an earling, similar to the earling 2800, but according to an alternate embodiment of the invention. Accordingly, the band 3200 includes two centerlines 3202 about which the article 3200 is generally bent when shaped to form an earling. The centerlines 3202 demarcate a center portion 3204 and end portions 3206 of the band 3200. In contrast to the band 2700, the end portions 3204 are canted from the center portion 3204 to further facilitate shaping of the earling as depicted in FIGS. 28-29, for better conformity to the anti-tragus 108 of the ear 100. Use of the earling formed from the band 3200 is substantially similar to the use of earling described above with respect to FIGS. 30-31.

Figure 33:
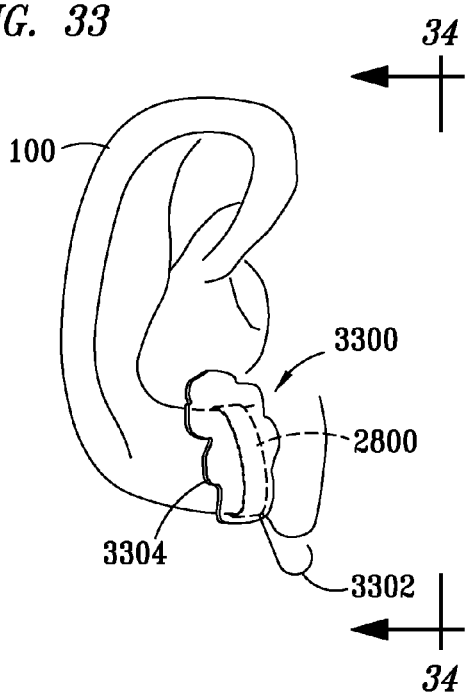
FIGS. 33-34 exemplify one embodiment of a first implementation of the embodiments of FIGS. 27-32, having an ornamental article is secured thereto.
Figure 34:
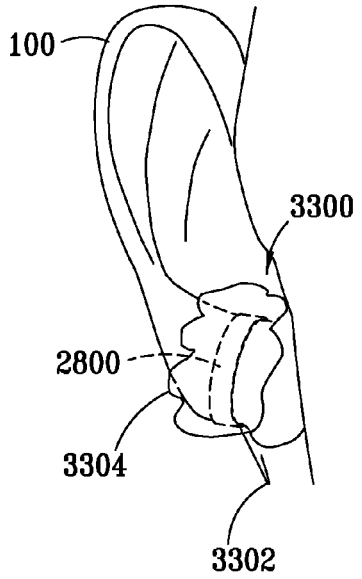

FIGS. 33 and 34 depict side and frontal elevation views of an embodiment of an earling 3300, similar to the earling 2800 described above with respect to FIGS. 27-32, but for the addition of a hook attachment 3302 and an ornamental object 3304 secured thereto, such as by means of adhesive, solder, or the like. The hook attachment 3302 may be altered in length, width, and angle to achieve different effects with different pendants, or, for example, to allow large earring designs to be attached thereto to cover the entire earlobe 110, or a portion of it. Use of the earling 3300 is substantially similar to the use of earling 2800 described above with respect to FIGS. 30-31, with the option to suspend a pendant (not shown) from the hook attachment 3302.

Figure 35:
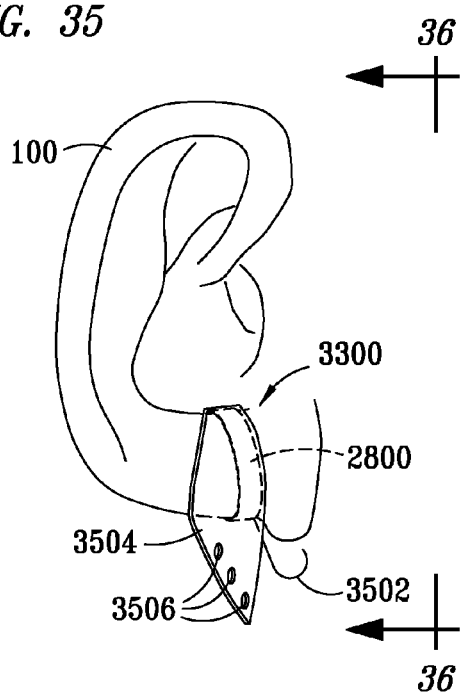
FIGS. 35 and 36 exemplify one embodiment of a second implementation of the embodiments of FIGS. 27-32, having an ornamental article is secured thereto.
Figure 36:
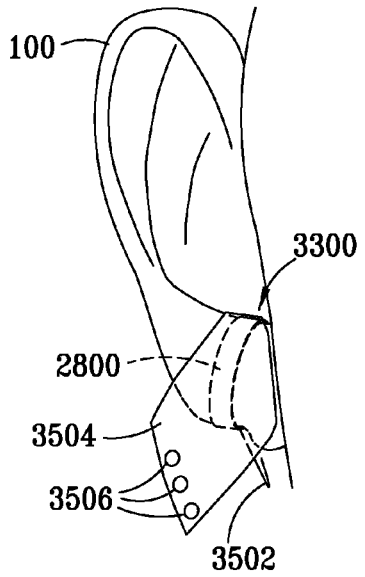

FIGS. 35 and 36 depict side and frontal elevation views of an embodiment of an earling 3500 having a hook attachment 3502 and an ornamental object 3504 secured thereto, as with the earling 3300 described above with respect to FIGS. 33-34, but for the addition of holes 3506 defined in the ornamental object 3504, the number of which holes 3506 are depicted by way of example, but not limitation. Use of the earling 3300 is substantially similar to the use of earling 2800 described above with respect to FIGS. 30-31, with the option to suspend a pendant (not shown) from the hook attachment 3502 or from the holes 3506.

Figure 37:
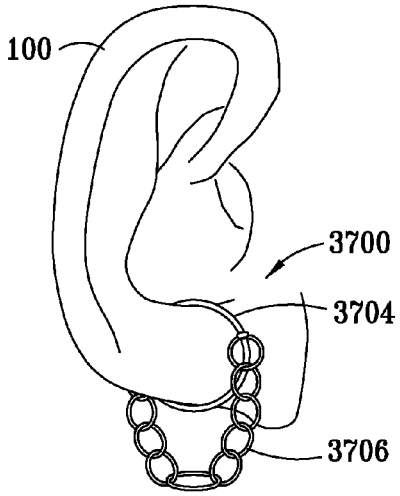
FIG. 37 is a perspective view exemplifying an alternative embodiment of the invention in which a chain is suspended from two points of an earling.

FIG. 37 is a perspective view exemplifying an alternative embodiment 3700 of the invention in which a chain 3706 is suspended from two points of an earling 3704, instead of just one point.

Figure 38:
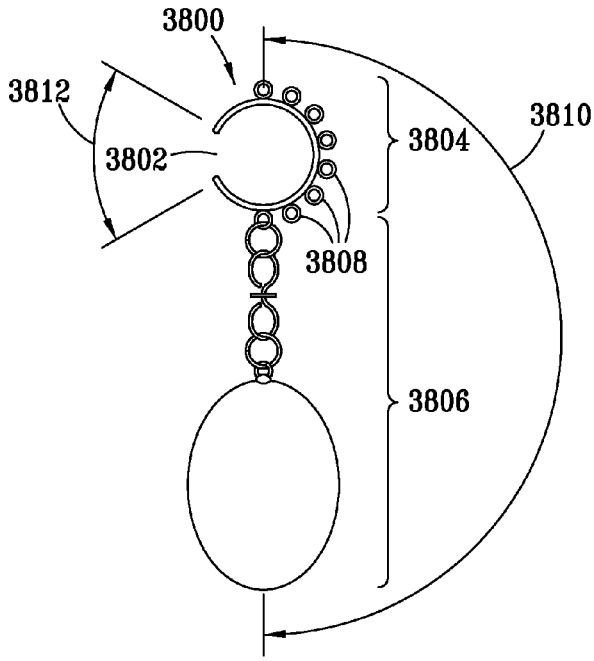
FIG. 38 is an elevation view exemplifying an alternative embodiment of the earling assembly of FIG. 2.

FIG. 38 is an elevation view exemplifying an alternative embodiment 3800 of the earling assembly 200 of FIG. 2, wherein additional loops, also known as jump rings, 3808 are secured to a convex edge of the earling 3804, providing additional points for attaching a pendant 3806. Similar to the earling assembly 200, the earling assembly 3800 preferably defines an opening 3802 of approximately 30° to 60°, as indicated by an arc 3812, and the jumprings 3808 are preferably defined within an arc 3810 of about 180° or less opposite the opening 3802.

Figure 39:
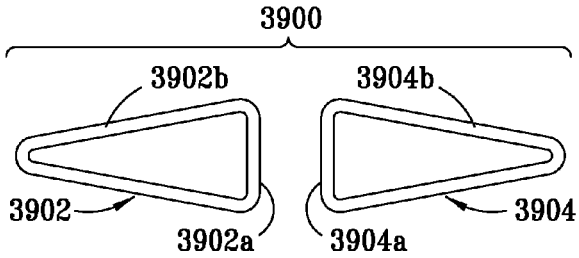
FIGS. 39-42 exemplify an alternate embodiment of the invention depicted by FIGS. 5-8, including pre-fabricated embodiments of same in FIGS. 39-40, a fabricated embodiment of same in FIG. 41, and an elevation view of same in FIG. 42 showing the earling positioned on the ear of FIG. 1.
Figure 40:
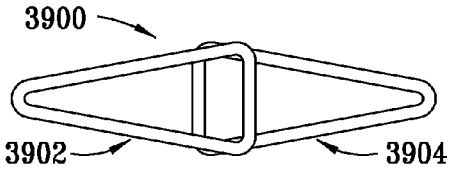
Figure 41:
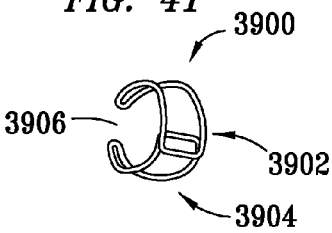
Figure 42:
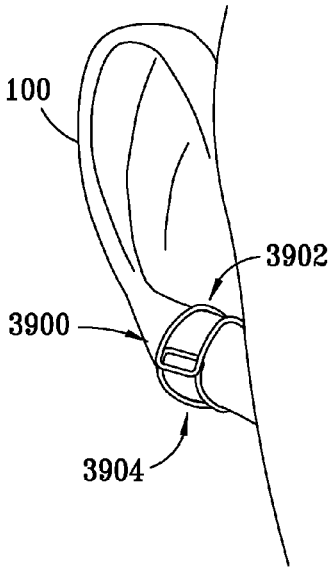

FIGS. 39-42 exemplify an alternate embodiment of the invention depicted by FIGS. 5-8. FIG. 39 is a pre-fabricated embodiment of two generally triangular-shaped portions 3902 and 3904 of an earling 3900, and in FIG. 40, the portions 3902 and 3904 are coupled together, in an overlapping manner, using any suitable means, such as adhesive, solder, or the like. In FIG. 41, the portions 3902 and 3904 are shaped in an annular manner to form an earling 3900 having a opening 3906. FIG. 42 exemplifies how the earling 3900 may be fitted onto an ear 100. While not shown, a pendant, such as the pendant 700 or 900 of FIGS. 7-10, may be suspended from the earling 3900.

Figure 43:
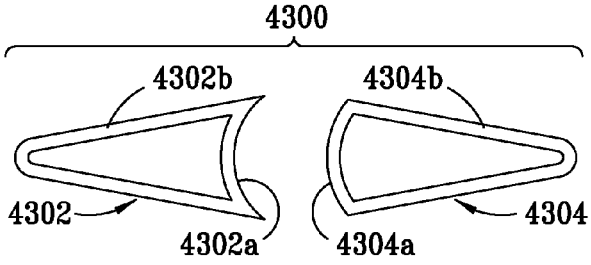
FIGS. 43-45 exemplify an alternate embodiment of the invention depicted by FIGS. 5-8, including pre-fabricated embodiments of same in FIGS. 43-44, and an elevation view of same in FIG. 45 showing the earling positioned on the ear of FIG. 1.
Figure 44:
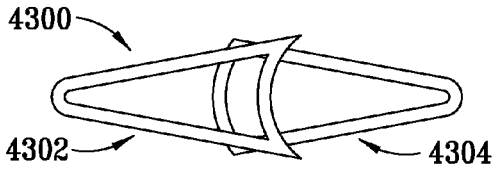
Figure 45:
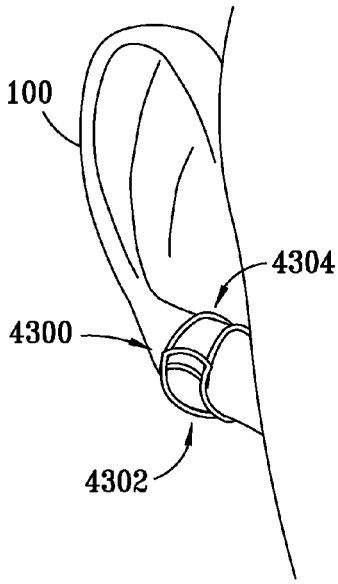

FIGS. 43-45 exemplify an alternate embodiment of the invention depicted by FIGS. 5-8. FIG. 43 is a pre-fabricated embodiment of two generally triangular-shaped portions 4302 and 4304 of an earling 4300, with bowed bases 4302*a* and 4304*a*. In FIG. 44, the portions 4302 and 4304 are coupled together, in an overlapping manner, using any suitable means, such as adhesive, solder, or the like. The portions 4302 and 4304 are shaped in an annular manner to form an earling 4300 having a opening, and FIG. 45 exemplifies how the earling 4300 may be fitted onto an ear 100. While not shown, a pendant, such as the pendant 700 or 900 of FIGS. 7-10, may be suspended from the earling 4300.

Figure 46:
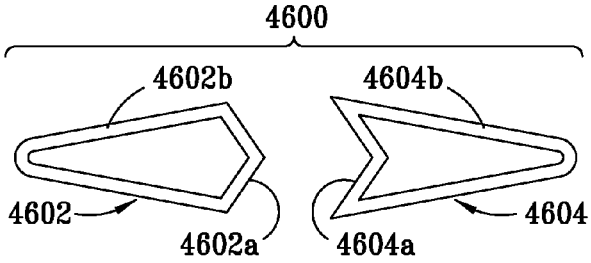
FIGS. 46-48 exemplify an alternate embodiment of the invention depicted by FIGS. 5-8, including pre-fabricated embodiments of same in FIGS. 46-47, and an elevation view of same in FIG. 48 showing the earling positioned on the ear of FIG. 1.
Figure 47:
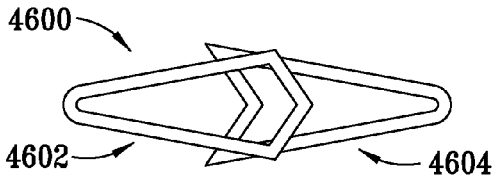
Figure 48:
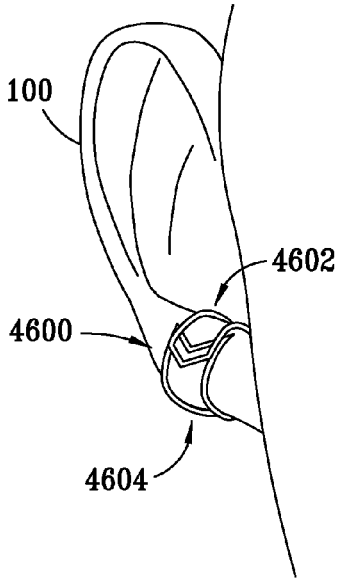
Figure 49:
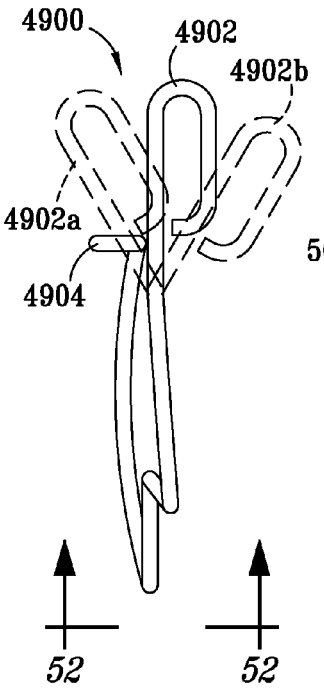
FIGS. 49-54 exemplify a further alternative embodiment of the invention.
Figure 50:
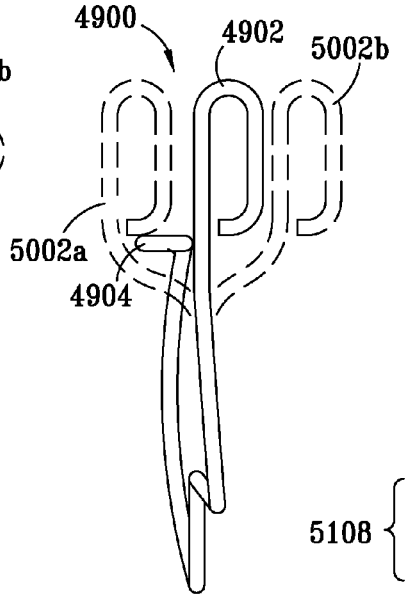
Figure 51:
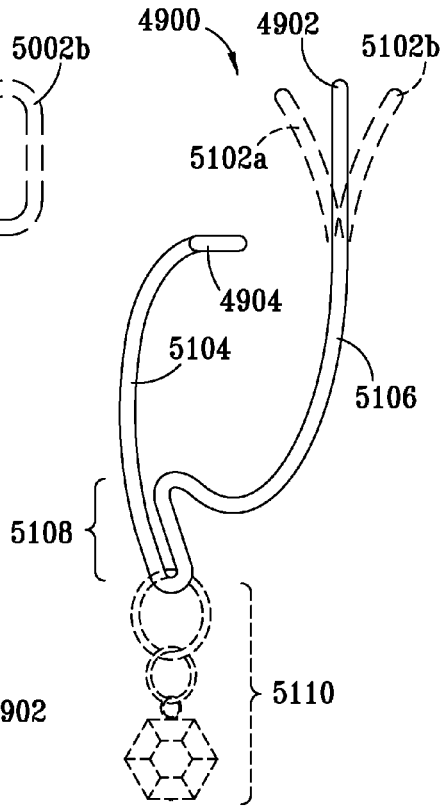
Figure 52:
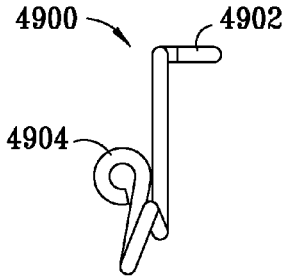
Figure 53:
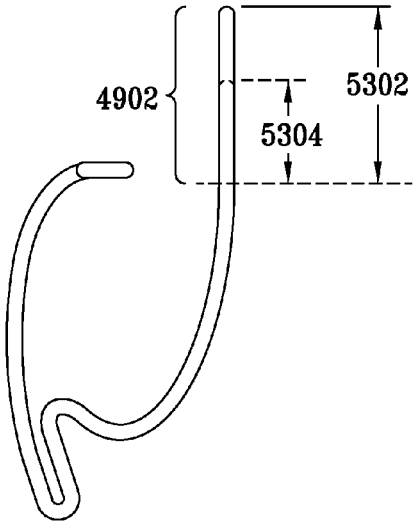

FIGS. 46-48 exemplify an alternate embodiment of the invention depicted by FIGS. 5-8. FIG. 46 is a pre-fabricated embodiment of two generally triangular-shaped portions 4602 and 4604 of an earling 4600, with angular bases 4602*a* and 4604*a*. In FIG. 47, the portions 4602 and 4604 are coupled together, in an overlapping manner, using any suitable means, such as adhesive, solder, or the like. The portions 4602 and 4604 are shaped in an annular manner to form an earling 4600 having a opening, and FIG. 48 exemplifies how the earling 4600 may be fitted onto an ear 100. While not shown, a pendant, such as the pendant 700 or 900 of FIGS. 7-10, may be suspended from the earling 4600.

Figure 54:
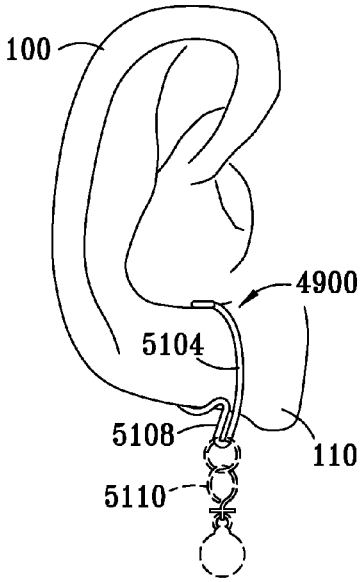

FIGS. 49-54 exemplify an earling 4900 embodying features of the invention. The earling 4900 preferably comprises an element, such as a wire, which is shaped to conform to a lower portion of the ear 100. Accordingly, the earling 49 includes a frontal, or outer, portion 5104 configured for wrapping around an outer portion of the lower ear, and an end 4904 configured for resting in an interior portion of the ear, the end 4904 preferably forming a loop for comfort when resting against the ear. The outer portion 5104 transitions into a hook 5108 configured for supporting an ornamental pendant, exemplified by a pendant 5110. The wire forming the outer portion 5104 and hook 5108 then transitions into a back support, or inner, portion 5106 configured for being positioned behind an earlobe, that is, between the ear and a wearer's head (not shown). The inner portion 5106 preferably terminates in a P-shaped loop 4902 which may be adjusted for a user's comfort and for securing the earling 4900 to a wearer's ear, as exemplified in dashed outline, designated alternatively by reference numerals 4902*a*, 4902*b*, 5002*a*, 5002*b*, 5102*a*, and 5102*b*. It may be appreciated that the earling 4900 is not drawn to scale, and that scale and proportions may vary; for example, the end 4902 may extend according to dimensions 5302 or 5304. FIG. 54 exemplifies how the earling 4900 may be worn on an ear 100 by a user.

Figure 55:
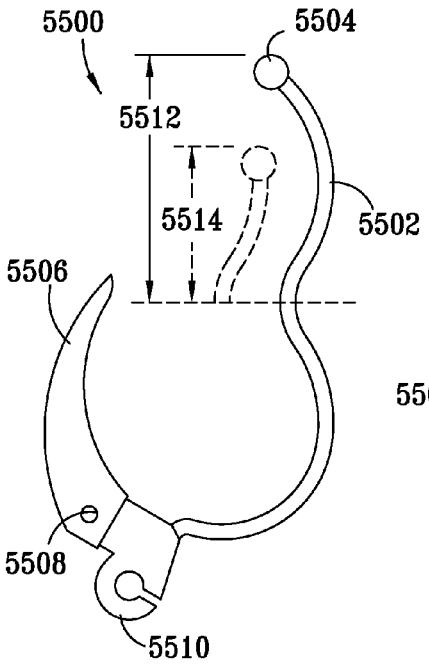
FIGS. 55-60 exemplify a still further alternative embodiment of the invention.
Figure 56:
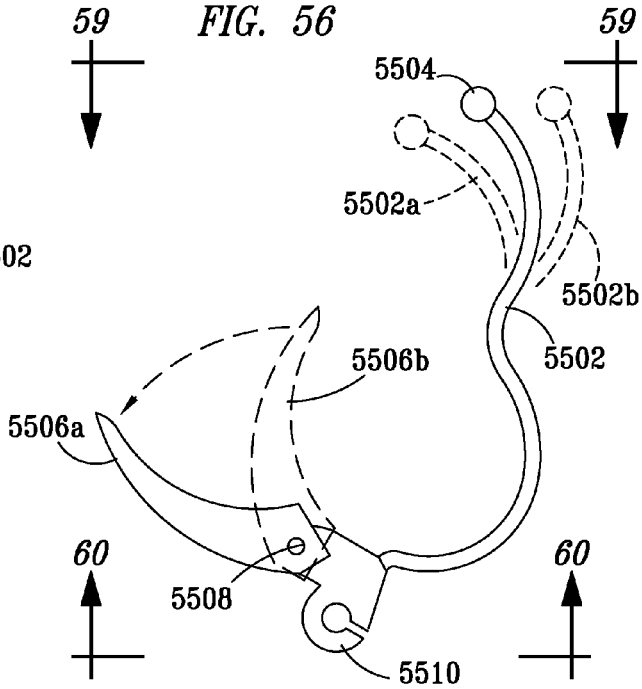
Figure 57:
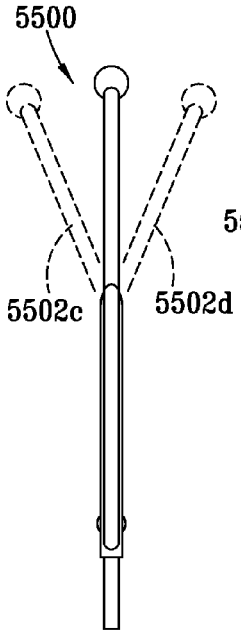
Figure 58:
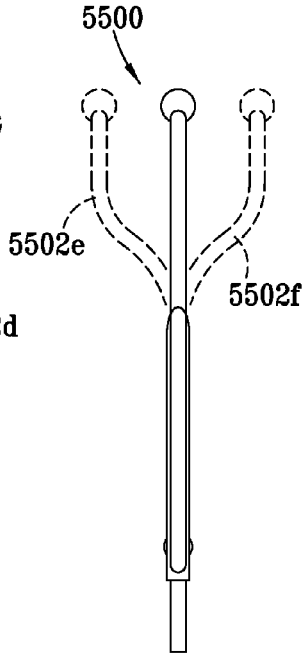
Figure 59:
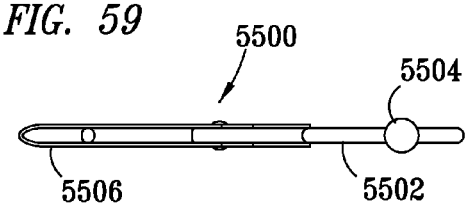
Figure 60:
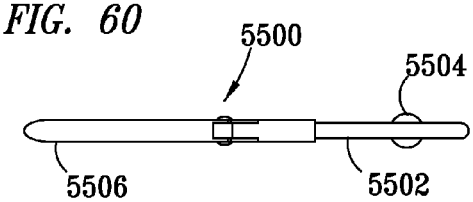

FIGS. 55-60 exemplify an earling 5500 embodying features of the invention. The earling 5500 preferably comprises a back support, or inner, portion 5502, preferably fabricated from a wire, which is shaped to conform to a "back side" of an ear 100, between the ear and a wearer's head. One end of the back support portion 5502 preferably comprises a substantially spherical shape 5504 for comfort when resting against the ear. An opposing end of the back support portion 5502 is connected to a hook portion 5510 of the earling 5500, the hook portion being configured for receiving and supporting an ornamental pendant (not shown). A frontal clasp portion 5506 is pivotably coupled at pivot 5508 to the hook portion 5510, the end of the clasp 5506 distal from the hinge being configured for resting in an interior portion of an ear. The clasp portion 5506 may assume and sustain an open position, depicted in FIG. 56 by the reference numeral 5506*a* for being positioned on, or removed from, an ear, or may assume and sustain a closed position, depicted in dashed outline in FIG. 56 by the reference numeral 5506*b* for being secured to an ear. The back support portion 5502 may be adjusted for fitting to a wearer's ear, as depicted in dashed outline via reference numerals 5502*a*, 5502*b*, 5502*c*, 5502*d*, 5502*e*, and 5502*f*, and may vary in dimension, as depicted in FIG. 55 by reference numerals 5512 and 5514. Still further, it is understood that any portion of the earling 5500 may vary in scale or proportion; for example, the earling 5500 may be configured so that the hook 5510 is positioned lower or higher on the earling.

Figure 61:
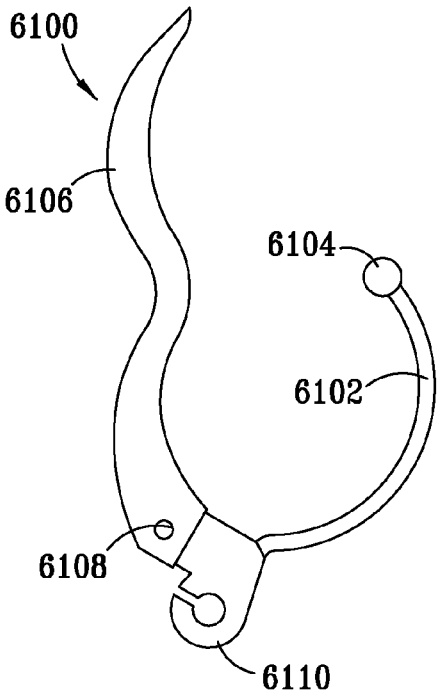
FIGS. 61-62 exemplify a still further alternative embodiment of the invention.
Figure 62:
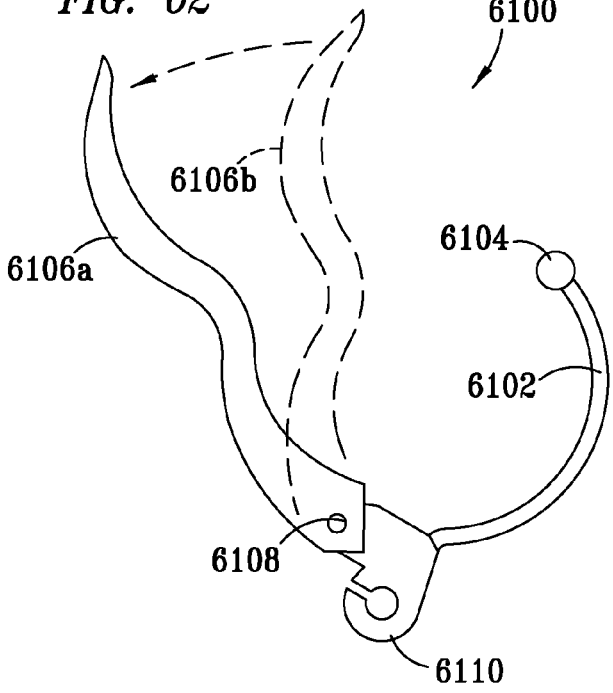

FIGS. 61-62 exemplify an earling 6100 embodying features of the invention, similar to the embodiment depicted by FIGS. 55-60. The earling 6100 preferably comprises a frontal, or outer, portion 6102, preferably fabricated from a wire, which is shaped to wrap around a "front side" of an ear 100. One end of the frontal portion 6102 preferably comprises a substantially spherical shape 6104 for comfort when resting in an interior portion of an ear. An opposing end of the frontal portion 6102 is connected to a hook portion 6110 of the earling 6100, the hook portion being configured for receiving and supporting an ornamental pendant (not shown). A back support clasp portion 6106 is pivotably coupled at pivot 6108 to the hook portion 6110. The back support clasp portion 6106 may assume and sustain an open position, depicted in FIG. 62 by the reference numeral 6106*a* for being positioned on, or removed from, an ear, or may assume and sustain a closed position, depicted in FIG. 56 by the reference numeral 6106*b* for being secured to an ear. It is understood that any portion of the earling 6100 may vary in scale or proportion.

Figure 63:
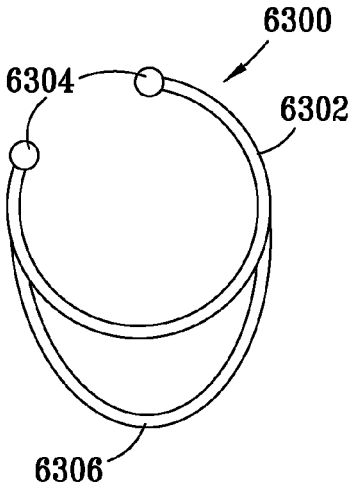
FIGS. 63-64 exemplify a still further alternative embodiment of the invention.
Figure 64:
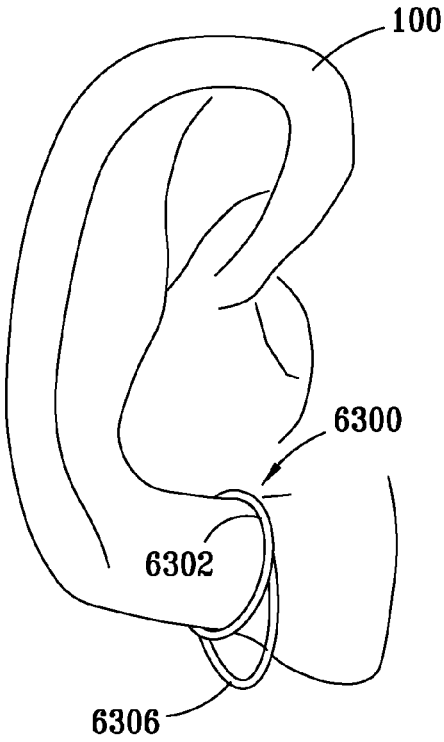

FIGS. 63-64 exemplify an earling 6300 embodying features of the invention. The earling 6300 preferably comprises a first element 6302, such as a wire, configured for wrapping around a lower portion of an ear. Each end of the element 6302 is preferably provided with a substantially spherical shape for comfort when resting against an ear. The earling 6300 further comprises a second element 6306, preferably also configured from wire, which extends from and bows outwardly from the first element 6302. FIG. 64 exemplifies wearing of the earling 6300 on an ear. It is understood that an ornamental pendant (not shown) may be suspended from the second element 6306.

By the use of the present invention, ornamental objects, or pendants, may be comfortably and reliably suspended from a person's ears without clips, or posts which require ears to be pierced. The invention allows for use of an open-ended ring secured to cartilage of the lower-most portion of the outer ear, to which pendants may or may not be attached. This enables clip-on earrings, post earrings, wire earrings, and the like, to be substantially supported from the cartilage of the ear, thus avoiding unsightly sagging of the earlobe over time, while at the same time rendering any pendants and add-ons to the earling to hang neatly alongside the head, much closer to the head than what is possible from traditional ear cuffs. Earlings overcome many drawbacks of ear cuffs by, for example, being sized larger than ear cuffs and thereby able to be situated at the lower-most portion of the outer ear, as opposed to further up the ear, as in an ear cuff.

It is understood that the present invention may take many forms and embodiments. Accordingly, several variations may be made in the foregoing without departing from the spirit or the scope of the invention. For example, an earling may be configured to receive a clip-on earring, or the earling may replace a clip in a clip-on earring. An earling may be shaped in a non-circular shape, such as an elliptical shape. An ear cuff may also be worn in conjunction with the earling and earling assembly. An earling may be provided with padding, of similar or dissimilar material to the earling, to render it more comfortable to a user and to prevent ends of an earling from jabbing a user. An earling may be sized for fitting over either the anti-tragus 108 and/or earlobe 110 of the ear 100. Portions of any earling may be combined with portions of other earlings to form a further earling embodying features of the present invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An apparatus comprising:

a ring defining an opening and a convex edge, said opening extending across an arc of about 30° to 60° of said ring;

a plurality of apertures defined through the sidewalls of said ring; and at least one pendant suspended from at least one of said plurality of apertures defined within an arc of about 180° of said ring, said arc being defined substantially opposite said opening, and across said convex edge.

2. The apparatus of claim 1, wherein said ring defines a substantially rectangular cross-section.

3. The apparatus of claim 1, wherein said ring defines a substantially elliptical cross-section.

4. The apparatus of claim 1, wherein said ring is fabricated from multiple layers of metal.

5. The apparatus of claim 1, wherein said ring is fabricated from non-metallic material.

6. The apparatus of claim 1, wherein said ring is fabricated from a band.

7. The apparatus of claim 1, wherein said ring is configured to receive a post of a pierced earring to thereby support said earring.

8. An apparatus consisting essentially of:

a first ring defining an opening and a convex edge, said opening extending across an arc of about 30° to 60° of said ring;

a plurality of apertures defined through the sidewalls of said first ring;

at least one second ring suspended from at least one of said plurality of apertures and circumscribing said convex edge; and at least one pendant suspended from said at least one second ring defined within an arc of about 180° of said ring, said arc substantially opposing said opening.

* * * * *